US009528394B2

(12) United States Patent
Fujioka et al.

(10) Patent No.: US 9,528,394 B2
(45) Date of Patent: Dec. 27, 2016

(54) POWER GENERATING APPARATUS AND METHOD OF OPERATING POWER GENERATING APPARATUS

(71) Applicant: Anest Iwata Corporation, Kanagawa (JP)

(72) Inventors: Tamotsu Fujioka, Kanagawa (JP); Atsushi Unami, Kanagawa (JP); Takaaki Izumi, Kanagawa (JP)

(73) Assignee: ANEST IWATA CORPORATION, Kanagawa (JP)

( * ) Notice: Subject to any disclaimer, the term of this patent is extended or adjusted under 35 U.S.C. 154(b) by 192 days.

(21) Appl. No.: 14/176,448

(22) Filed: Feb. 10, 2014

(65) Prior Publication Data

US 2014/0223907 A1 Aug. 14, 2014

(30) Foreign Application Priority Data

Feb. 14, 2013 (JP) ..... 2013-026853

(51) Int. Cl.
*F01K 9/00* (2006.01)
*F01K 13/02* (2006.01)
(Continued)

(52) U.S. Cl.
CPC ..... *F01K 9/003* (2013.01); *F01K 13/02* (2013.01); *F01K 25/08* (2013.01)

(58) Field of Classification Search
CPC ..... F01K 9/00; F01K 9/003; F01K 9/006; F01K 9/02; F01K 9/023; F01K 9/026; F01K 9/04; F28B 7/00
(Continued)

(56) References Cited

U.S. PATENT DOCUMENTS 3,887,666 A * 6/1975 Heller ..... F28D 5/02 165/138
4,506,508 A * 3/1985 Coers ..... F01K 9/003 165/110

(Continued)

FOREIGN PATENT DOCUMENTS

BE 1006285 A3 7/1994
CA 2 222 607 8/2006

(Continued)

OTHER PUBLICATIONS

Mass Flow Versus Volumetric Flow—First Sensor 2015.*
European Search Report issued Jul. 8, 2014 in corresponding European Patent Application No. 14155010.

*Primary Examiner* — Thomas Denion
*Assistant Examiner* — Jessica Kebea
(74) *Attorney, Agent, or Firm* — Wenderoth, Lind & Ponack, L.L.P.

(57) ABSTRACT

Provided is a power generating apparatus including an evaporator configured to evaporate a working medium with a heating medium supplied from the outside of a working medium flow path, an expander to which a driven machine is connected and which is configured to convert expansion force of the evaporated working medium into rotational force to drive the driven machine, a condensing mechanism configured to condense the working medium discharged from the expander with a cooling medium supplied from the outside of the working medium flow path, the condensing mechanism having at least one heat exchanger pipe through which the working medium flows, a cooling water sprayer configured to spray cooling water as the cooling medium over the surface of one or a plurality of heat exchanger pipes of the at least one heat exchanger pipe, and a cooling fan configured to blow ambient air over the one or a plurality of heat exchanger pipes to evaporate cooling water attached to (Continued)

the surface of the one or a plurality of heat exchanger pipes, and a circulating pump configured to pressurize and supply the condensed working medium to the evaporator.

11 Claims, 5 Drawing Sheets

(51) Int. Cl.
*F01K 23/08* (2006.01)
*F01K 25/08* (2006.01)

(58) Field of Classification Search
USPC ..... 60/645, 670, 661, 693
See application file for complete search history.

(56) References Cited

U.S. PATENT DOCUMENTS 4,553,396 A * 11/1985 Heizer ..... C02F 1/16 159/4.01
4,628,212 A * 12/1986 Uehara ..... F03G 7/05 290/1 R
4,926,931 A * 5/1990 Larinoff ..... F28B 1/06 165/111
6,374,614 B2 * 4/2002 Prueitt ..... F03G 6/06 60/641.15
7,018,558 B2 * 3/2006 Schnur ..... C09K 5/045 252/68
7,926,555 B2 * 4/2011 Sanderlin ..... F28B 1/02 165/103
7,946,338 B2 * 5/2011 Szabo ..... F28B 1/06 165/108
2009/0071156 A1 3/2009 Nishikawa et al.
2011/0066298 A1 * 3/2011 Francino ..... F01K 9/003 700/290
2011/0083456 A1 * 4/2011 Wakamoto ..... F25B 41/00 62/115
2011/0203279 A1 * 8/2011 Duong ..... F01K 9/00 60/670
2012/0096864 A1 * 4/2012 Chillar ..... F01K 9/003 60/660
2013/0118169 A1 * 5/2013 Milam ..... F01K 25/08 60/651
2014/0078868 A1 * 3/2014 McCaskill, III ..... G07C 3/04 368/9
2014/0140810 A1 * 5/2014 Balistreri ..... F04D 19/002 415/1

FOREIGN PATENT DOCUMENTS

EP 0 342 005 11/1989
GB 342517 2/1931
GB 2473543 3/2011
IT WO 2005119014 A1 * 12/2005 ..... F24D 10/00
JP 2011-214430 10/2011
JP 2012202269 A * 10/2012
SU 1366840 A1 * 1/1988
WO 94/18515 8/1994

* cited by examiner

*Fig. 5* - PRIOR ART
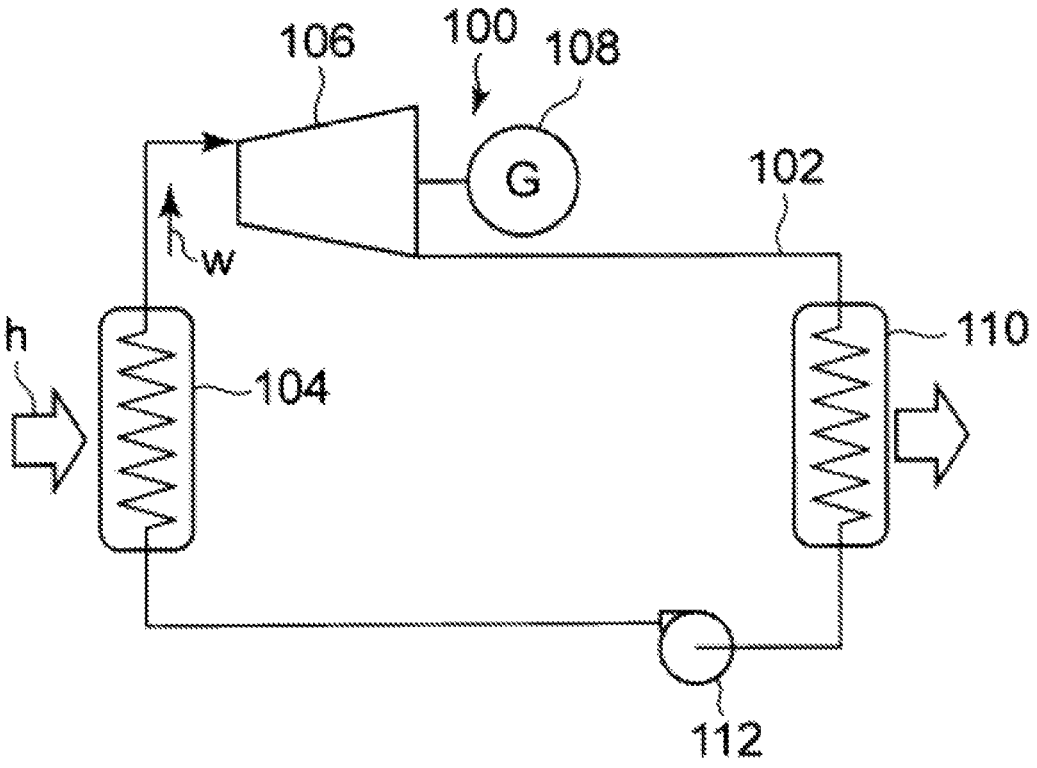

POWER GENERATING APPARATUS AND METHOD OF OPERATING POWER GENERATING APPARATUS

BACKGROUND OF THE INVENTION

The present invention relates to a power generating apparatus performing electric power generation or the like by a Rankine cycle using a heat source such as a hot-spring or subterranean heat source. The present invention also relates to a method of operating such a power generating apparatus.

In recent years, the need and market for small-sized electric power generation have been growing with the spread of energy conservation and with the enactment of the Act on Special Measures Concerning the Procurement of Renewable Electric Energy by Operators of Electric Utilities. In this trend, attention has been paid to a binary electric power generation system using a low-boiling point working medium and hence capable of utilizing a low-temperature heat source not higher than 100° C. such as a heat source obtained from a hot spring, engine exhaust heat, plant exhaust heat, and solar heat. The binary electric power generation system uses a Rankine cycle as a heat cycle and therefore needs a hot heat source for evaporating a working medium and a cold heat source for condensing the evaporated working medium.

As a cold heat source, ground water, tap water, river water, or the like is used, and as a cooling device, as cooling tower, a chiller, or the like is used. Particularly, organic binary electric power generation using a low-boiling point organic working medium, e.g. HFC245fa, is receiving attention as an epoch-making electric power generation method capable of using a heat source having an even lower temperature by utilizing the evaporation and condensation characteristics of a low-boiling point organic working medium.

FIG. 5 shows a conventional general binary electric power generating apparatus 100. In FIG. 5, a closed-loop circulation path 102 through winch a working medium circulates is provided with an evaporator 104, an expander 106, and a condenser 110. The expander 106 is connected to an electric power generator 108 through a driving shaft. In the evaporator 104, a working medium w exchanges heat with a heating medium h and evaporates by absorbing heat from the heating medium h. The working medium w increased in pressure by evaporation enters the expander 106. In the expander 106, the working medium w adiabatically expands and drives the electric power generator 108 by the expansion force to perform electric power generation. After adiabatically expanding, the working medium w exchanges heat with a cooling medium in the condenser 110 and is cooled to condense by the cooling medium. The condensed working medium w is sent to the evaporator 104 by a circulating pump 112.

The binary electric power generation can generate electric power even with a low-temperature heat source, and on the other hand, needs a condensing step using a cold heat source because the binary electric power generation uses a heat cycle in which a working medium circulates through a closed loop. The condensing step is generally a step in which a working medium and cooling water are allowed to exchange heat with each other by using a heat exchanger to condense the working medium, and the condensed working medium is sent to an evaporator by a liquid pump. In many cases, around water, river water, tap water, or the like is used as a cold heat source, and a cooling tower, a chiller, or the like is used as a device for cooling the cold heat source. It is, however, difficult to procure a large amount of water, and a large pumping power is required to supply a large amount of cooling water, which causes the real effective electric generation to be reduced to as considerable extent. In addition, the use of river water is accompanied by the problem of water rights. The use of tap water increases the water bill. The use of a cooling tower increases the electric bill.

Japanese Patent Laid-Open Publication No. 2011-214430 (Document 1) discloses a condensing mechanism for use in as binary electric power generating apparatus. In the condensing mechanism, a working medium liquid lowered in temperature by being cooled in a utilization-side heat exchanger is used as a cooling medium for cooling another working medium in a condenser. That is, the working medium liquid liquefied in the condenser is distributed into two systems, i.e. a flow path leading to an evaporator, and as flow path leading to the utilization-side heat exchanger, and the working medium evaporated by absorbing heat in the evaporator and the working medium cooled in the utilization-side heat exchanger are brought into direct contact with each other in the condenser to exchange heat therebetween.

SUMMARY OF INVENTION

In view of the above-described existing problem, it is necessary to operate the binary electric power generation system without the need to procure as large amount of cooling water. One approach to solve the problem is to allow the working medium and the cooling medium to perform not only sensible heat exchange but also latent heat exchange, which enables an increase in the amount of heat exchange.

The condensing mechanism disclosed in Document 1 utilizes the latent heat of condensation of the working medium liquid cooled in the utilization-side heat exchanger and, theoretically, does not use cooling water. With this condensing mechanism, however, the amount of heat exchange in the condenser may vary with variations in the amount of working medium liquid distributed and in the amount of heat absorbed by the working medium in the evaporator and also variations in the amount of heat dissipated from the working medium in the utilization-side heat exchanger, so that it may become impossible to form a Rankine cycle exhibiting excellent thermal efficiency.

The present invention has been made in view of the above-described problems.

Accordingly, an object of the present invention is to realize a power generating apparatus using a low-boiling point working medium and hence capable of utilizing a low-temperature heat source as in the case of a binary electric power generation system, in which the condensing step does not require a large amount of cooling water, and which, therefore, dispenses with the pumping power and piping installation otherwise required to transfer a large amount of cooling water.

Another object of the present invention is to form a Rankine cycle exhibiting excellent thermal efficiency by controlling the degree of liquefaction of the working medium at the outlet of the condenser.

To attain the above-described object, the power generating apparatus according to the present invention includes an evaporator configured to evaporate a working medium with a heating medium supplied from the outside of as working medium flow path, an expander to which a driven machine, e.g. an electric power generator, is connected and which is configured to convert the expansion force of the evaporated working medium into rotational force to drive the driven machine, a condensing mechanism configured to condense the working medium discharged from the expander with a cooling medium supplied from the outside of the working medium flow path, and a circulating pump configured to pressurize and supply the condensed working medium to the evaporator.

The condensing mechanism comprises at least one heat exchanger pipe through which the working medium flows, a cooling water sprayer configured to spray cooling water as the cooling medium over one or a plurality of heat exchanger pipes of the at least one heat exchanger pipe, and a cooling fan configured to blow ambient air over the one or a plurality of heat exchanger pipes to evaporate cooling water attached to the surface of the one or a plurality of heat exchanger pipes.

BRIEF DESCRIPTION OF DRAWINGS

FIG. 5 is a system diagram of a conventional binary electric power generating apparatus.

DESCRIPTION OF EMBODIMENTS

The present invention will be explained below in detail by using embodiments shown in the accompanying drawings. It should be noted that the dimensions, materials, shape, relative dispositions, and so forth of the constituent components described in the following embodiments do not limit the scope of the present invention to themselves alone, unless specifically indicated otherwise.

First Embodiment

Figure 1:
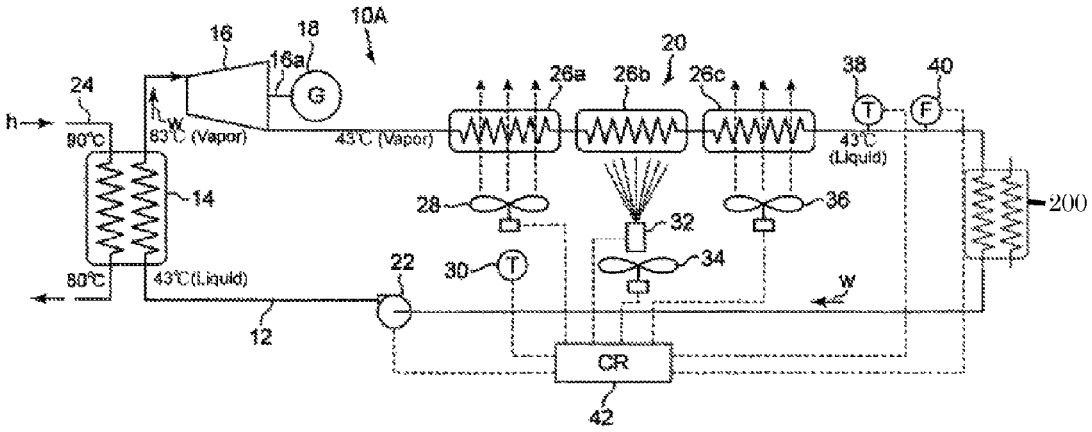
FIG. 1 is a system diagram of a binary electric power generating apparatus according to a first embodiment of the present invention.
Figure 2:
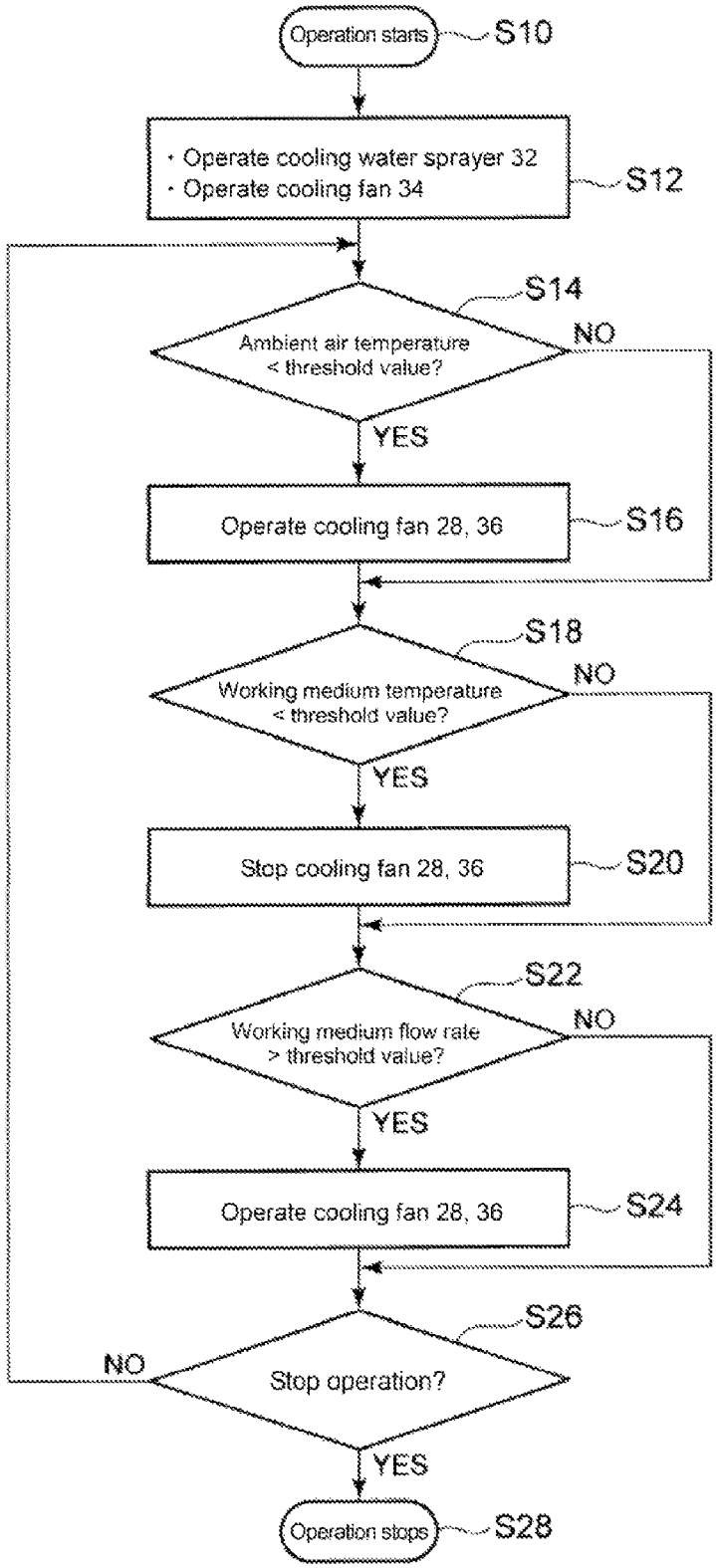
FIG. 2 is a flowchart showing a method of operating the binary electric power generating apparatus according to the first embodiment.

A first embodiment of the present invention in which the present invention is applied to a binary electric power generating apparatus will be explained based on FIGS. 1 and 2. In FIG. 1, a binary electric power generating apparatus 10A according to the first embodiment has a circulation path 12 (closed loop) as a working medium flow path through which a working medium circulates. A low-boiling point organic working medium w, e.g. an alternative fluorocarbon such as HFC245fa, circulates through the circulation path 12. The circulation path 12 is provided with an evaporator 14, an expander 16, a condensing mechanism 20, and a circulating pump 22. A circulation path 24 is connected to the evaporator 14. Through the circulation path 24, a heating medium h is circulated, which is supplied from the outside of the circulation path 12 (closed loop). The heating medium h comprises a heating medium having absorbed a hot heat source obtained from a hot spring, or a heating medium having absorbed plant exhaust heat or engine exhaust heat, or a heating medium having absorbed solar heat. The heating medium h exchanges heat with the working medium w to heat and evaporate the working medium w.

The expander 16 comprises, for example, a turbine type expander, or a scroll type expander. The expander 16 is connected to an electric power generator 18 through a driving shaft 16*a*. The working medium w evaporated in the evaporator 14 adiabatically expands in the expander 16 and rotates the driving shaft 16*a* by the expansion force. The rotation of the driving shaft 16*a* causes electromotive three to be generated in the electric power generator 18, thereby enabling electric power generation. After having expanded in the expander 16, the working medium w is cooled to condense in the condensing mechanism 20. The condensed working medium w is sent to the evaporator 14 by the circulating pump 22.

The condensing mechanism 20 has three heat exchanger pipe groups 26*a*, 26*b* and 26*c* provided in series to the circulation path 12. Each of heat exchanger pipe groups 26*a*, 26*b* and 26*c* includes one or plurality of heat exchanger pipe. The upstream-side heat exchanger pipe group 26*a* is provided with a cooling fan 28 blowing ambient air over the heat exchanger pipe group 26*a*. The heat exchanger pipe group 26*a* further has a temperature sensor 30 provided near the cooling fan 28 to detect the temperature of ambient air to be sent to the heat exchanger pipe group 26*a*. The heat exchanger pipe group 26*b*, which is located downstream the heat exchanger pipe group 26*a*, is provided with a cooling water sprayer 32 configured to spray cooling water over the surfaces of one or plurality of heat exchanger pipes constituting the heat exchanger pipe group 26*b*. The heat exchanger pipe group 26*b* is further provided with a cooling fun 34 blowing ambient air toward the heat exchanger pipe group 26*b* to evaporate cooling water attached to the surfaces of the heat exchanger pipe group 26*b*.

The heat exchanger pipe group 26*c*, which is located downstream the heat exchanger pipe group 26*b*, is provided with a cooling fan 36 blowing ambient air over the heat exchanger pipe group 26*c*. The circulation path 12 is provided, at the outlet side of the condensing mechanism 20, with a temperature sensor 38 detecting the temperature of the working medium w flowing through the circulation path 12, and a flow sensor 40 detecting the flow rate of the working medium w.

Detected values of the temperature sensors 30 and 38 and the flow sensor 40 are input to a control device 42. On the basis of these detected values, the control device 42 controls the delivery flow rate of the circulating pump 22, the start and stop and air volume of the cooling fans 28, 34 and 36, and the start and stop and cooling water spray quantity of the cooling water sprayer 32. For example, the control device 42 controls the cooling water sprayer 32 and the cooling fan 34 on the basis of the detected values of the temperature sensor 38 and/or the flow sensor 40 to control the degree of liquefaction of the working medium to a target value or within a target range. More specifically, the control device 42 controls the start and stop and cooling water spray quantity of the cooling water sprayer 32 and the start and stop and air volume of the cooling fan 34 on the basis of the detected values of the temperature sensor 38 and/or the flow sensor 40 to control the degree of liquefaction of the working medium to a target value or within a target range. Further, the control device 42 controls the start and stop and air volume of at least either one of the cooling fans 28 and 36 on the basis of the detected values of the temperature sensor 38 and/or the flow sensor 40 to control the degree of liquefaction of the working medium to a target value or within a target range. Further, the control device 42 controls the start and stop and cooling water spray quantity of the cooling water sprayer 32 and the start and stop and air volume of the cooling fan 34 and the start and stop and air volume of at least either one of the cooling fans 28 and 36 on the basis of the detected values of the temperature sensor 38 and/or the flow sensor 40 to control the degree of liquefaction of the working medium to a target value or within a target range.

Next, the method of operating the binary electric power generating apparatus 10A will be explained with reference to FIG. 2. In FIG. 2, at the same time as the operation starts (S10), the cooling water sprayer 32 and the cooling fan 34 are started (S12). At this time, the cooling fan 34 may be started to blow ambient air after the cooling water sprayer 32 has been started to spray cooling water. By so doing, it is possible to ensure sufficient time for evaporation of cooling water attached to the surfaces of the one or plurality of heat exchanger pipes.

When the ambient air temperature detected with the temperature sensor 30 is below a threshold value (S14), either or both of the cooling fans 28 and 36 are operated (S16). When the ambient air temperature is not less than the threshold value, even if the cooling fan 28 or 36 is operated, no cooling effect for cooling the working medium w can be obtained. Therefore, neither the cooling fan 28 nor 36 is operated. When the temperature of the working medium w detected with the temperature sensor 38 is below a threshold value (S18), at least either one of the cooling fans 28 and 36 is stopped (S20). When the flow rate of the working medium w detected with the flow sensor 40 exceeds a threshold value (S22), it is judged that cooling of the working medium w is insufficient, and either or both of the cooling fans 28 and 36 are operated (S24). Next, the process returns to S14 to repeat S14 and the following steps (S26).

The threshold value of the temperature of the working medium w at S18 is, for example, the known saturation temperature of the working medium at the pressure in the condensing mechanism 20. The threshold value of the flow rate of the working medium w at S22 is, for example, the flow rate of the working medium w when the whole quantity thereof is liquid.

It should be noted that, whet the temperature of the working medium w detected with the temperature sensor 38 is below a threshold value (S18), the cooling water sprayer 32 and the cooling fan 34, and/or either or both of the cooling fans 28 and 36 may be stopped (S20). When the flow rate of the working medium w detected with the flow sensor 40 exceeds as threshold value (S22), the cooling water sprayer 32 and the cooling fan 34, and/or either or both of the cooling fans 28 and 36 may be operated (S24).

FIG. 1 shows an example of the temperature of the heating medium h and the working medium w in each step when hot water of 90° C. is used as the heating medium h and HFC245fa (alternative fluorocarbon) is used as the working medium w. In the condensing step performed by the condensing mechanism 20, the temperature does not change while the working medium w is changing from vapor into liquid. Therefore, the degree of liquefaction (gas-liquid mixing ratio during the time that the working medium w is changing from vapor into liquid is detected with the flow sensor 40. That is, the control device 42 compares the flow rate of the working medium w detected with the flow sensor 40 with the flow rate of the working medium w when the whole quantity thereof is liquid, and obtains a degree of liquefaction by arithmetic calculation.

When the working medium temperature is below the threshold value, this shows that the working medium w has been all liquefied and cooled more than necessary. Therefore, at least either one of the cooling fans 28 and 36 are stopped. When the flow rate of the working medium w exceeds the threshold value, this shows that the proportion of vapor to liquid is high. Therefore, the cooling of the working medium w is judged to be insufficient, and either or both of the cooling fans 28 and 36 are operated.

According to this embodiment, after cooling water has been sprayed over the heat exchanger pipe group 26*b* with the cooling water sprayer 32, ambient air is blown over the heat exchanger pipe group 26*b* to cool the working medium w by utilizing the nature of cooling water to absorb latent heat of vaporization from the surroundings when evaporating from the surfaces of the heat exchanger pipes constituting the heat exchanger pipe group 26*b*. Thus, the power generating apparatus performs not only sensible heat exchange between the working medium w and cooling water but also latent heat exchange. Accordingly, the power generating apparatus does not require a large amount of cooling water, and dispenses with the pumping power and piping installation otherwise required to transfer a large amount of cooling water, which results in a reduced cost.

Thus, the amount of spray water used for cooling becomes markedly smaller than in the case of a general sensible heat exchange system using a heat exchanger. Therefore, even if disposed of as rainwater, spray water used for cooling has no influence on the environment. In addition, a Rankine cycle exhibiting excellent thermal efficiency can be formed because the control device 42 controls the degree of liquefaction of the working medium w at the outlet of the condensing mechanism 20.

In addition, it is possible to increase the cooling effect of the condensing mechanism 20 and to control the degree of liquefaction of the working medium w with high accuracy because the heat exchanger pipe groups 26*a* and 26*c* are provided with the cooling fans 28 and 36, respectively, and the control device 42 controls the operation of the cooling fans 28 and 36 according to the ambient temperature of the heat exchanger pipe groups 26*a* to 26*c*.

It should be noted that if a sufficient cooling effect cannot be obtained by using the condensing mechanism 20, the circulation path 12 may be provided with a heat exchanger 200 separately, through which a refrigerant or brine circulates, which has been cooled in a refrigerator constituting a refrigerating cycle. The cooling capacity is reinforced by cooling the working medium w with the refrigerant or brine sent from the refrigerator. This structure is also applicable to other embodiments.

Second Embodiment

Figure 3:
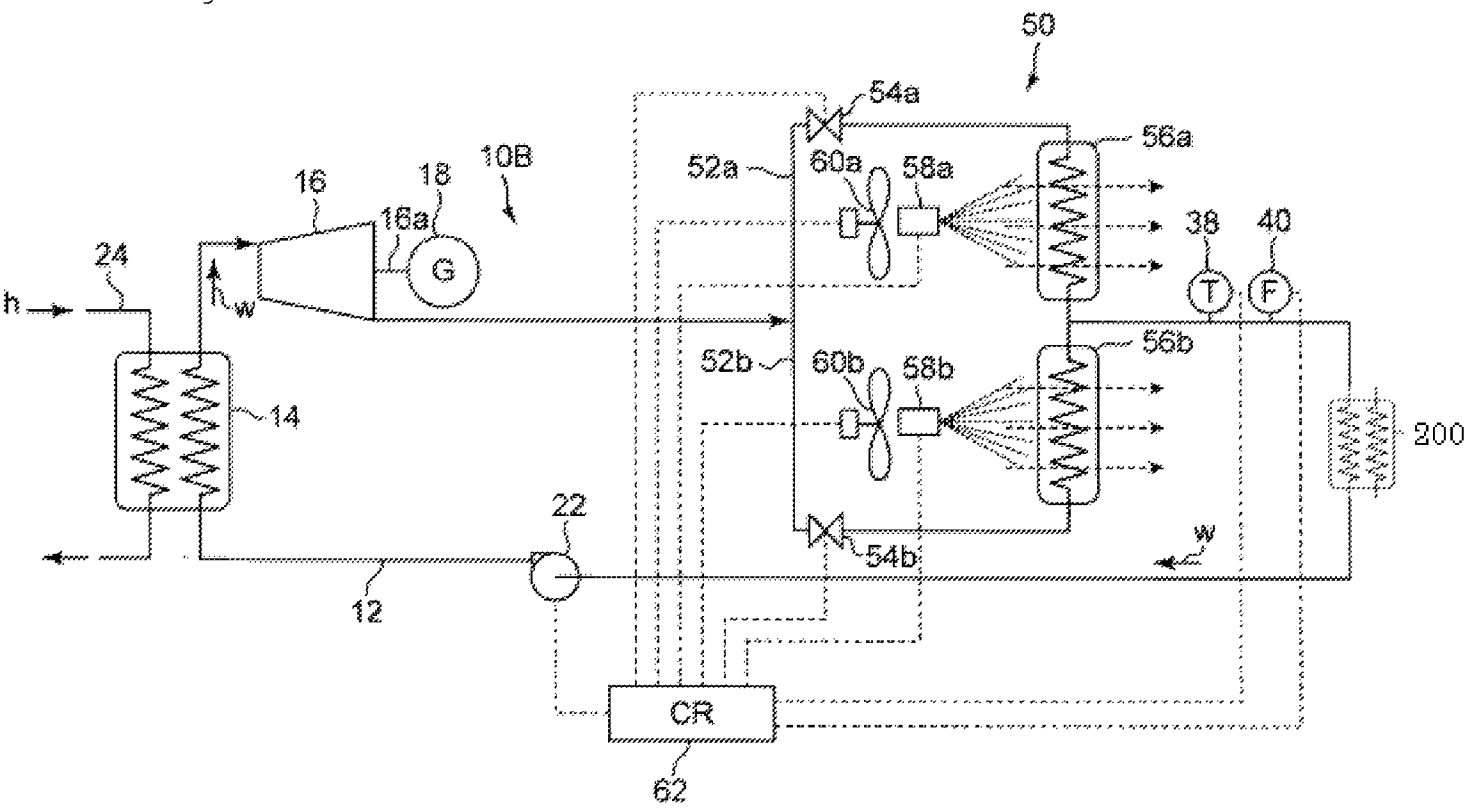
FIG. 3 is a system diagram of a binary electric power generating apparatus according to a second embodiment of the present invention.
Figure 4:
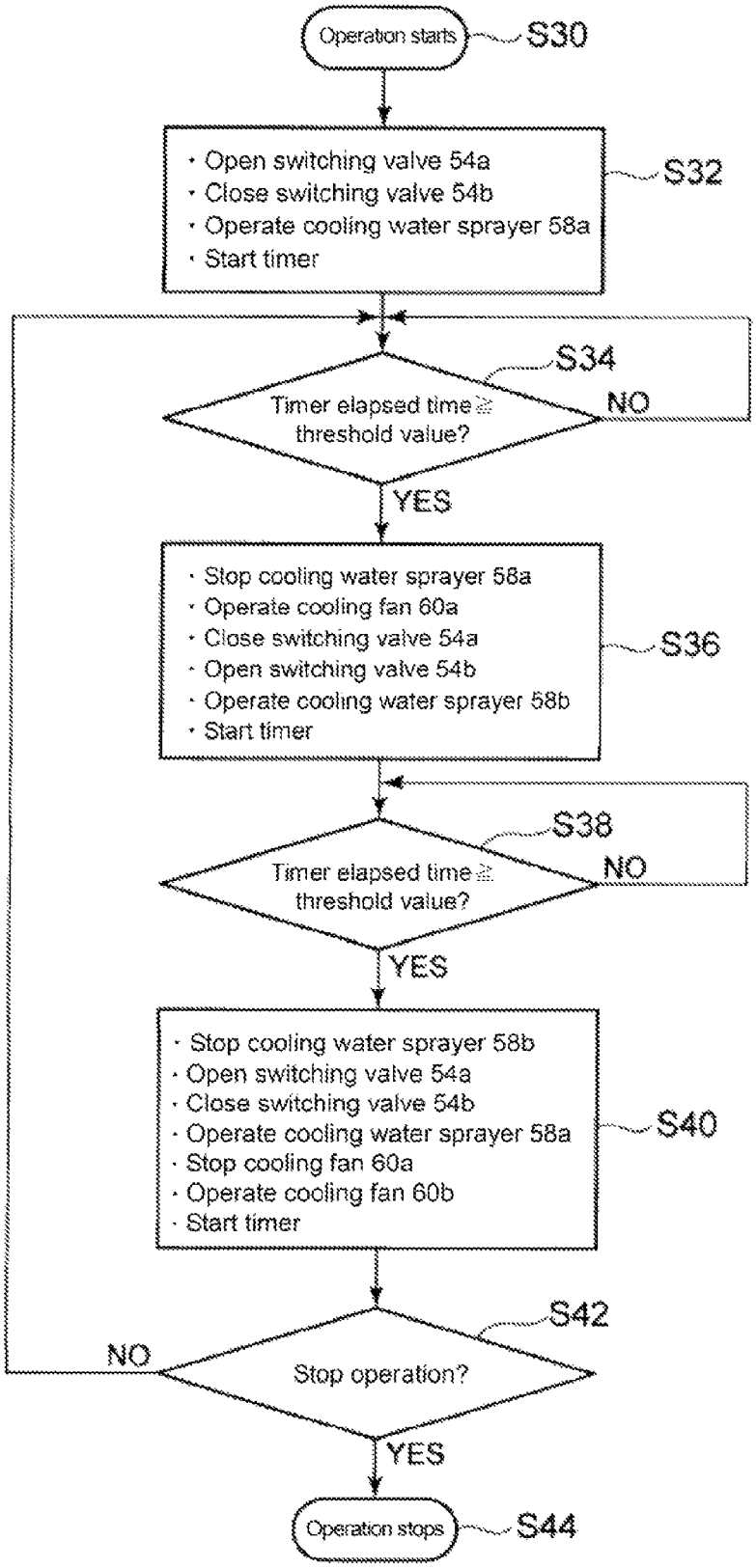
FIG. 4 is a flowchart showing as method of operating the binary electric power generating apparatus according to the second embodiment.

Next, a second embodiment of the present invention will be explained with reference to FIGS. 3 and 4. A binary electric power generating apparatus 10B shown in FIG. 3 differs from the binary electric power generating apparatus 10A of the above-described first embodiment in the structure of the condensing mechanism. A condensing mechanism 50 in the second embodiment has mutually parallel branch paths 52*a* and 52*b* of two systems, which branch off from the circulation path 12. The branch paths 52*a* and 52*b* are provided with switching valves 54*a* and 54*b* at their respective inlets and further provided with heat exchanger pipe groups 56*a* and 56*b*, respectively. Each of heat exchanger pipe groups 56*a* and 56*b* includes one or plurality of heat exchanger pipe.

The heat exchanger pipe group 56*a* is provided with a cooling water sprayer 58*a* configured to spray cooling water over the surfaces of one or plurality of heat exchanger pipes constituting the heat exchanger pipe group 56*a*, and a cooling fan 60*a* configured to blow ambient air over the one or plurality of heat exchanger pipe group 56*a*. The heat exchanger pipe group 56*b* is provided with a cooling water sprayer 58*b* configured to spray cooling water over the surfaces of one or plurality of heat exchanger pipes constituting the heat exchanger pipe group 56*b*, and a cooling fan 60*b* blowing ambient air over the one or plurality of heat exchanger pipe group 56*b*.

In addition, the circulation path 12 is provided, at the outlet of the condensing mechanism 50, with a temperature sensor 38 configured to detect the temperature of the working medium w, and a flow sensor 40 configured to detect the flow rate of the working medium w, in the same way as the above-described first embodiment. Detected values of the temperature sensor 38 and the flow sensor 40 are input to a control device 62. On the basis of these detected values, the control device 62 controls the delivery flow rate of the circulating pump 22, the start and stop and cooling water spray quantity of the cooling water sprayers 58*a* and 58*b*, and the start and stop and air volume of the cooling fans 60*a* and 60*b*. The rest of the structure of the second embodiment is the same as the first embodiment. Therefore, the same devices and the same members are denoted by the same reference signs as used in the first embodiment.

The method of operating the binary electric power generating apparatus 10B having the above-described structure will be explained with reference to FIG. 4. In FIG. 4, at the same time as the operation starts (S30), the control device 62 controls the switching valves 54*a* and 54*b* to introduce a working medium w into either one of the branch paths 52*a* and 52*b*, e.g. the branch path 52*a* (S32). At the same time, at the branch path 52*a*, cooling water is sprayed from the cooling water sprayer 58*a* toward the heat exchanger pipe group 56*a* (cooling water spray step). The control device 62 has a built-in timer. When the elapsed time on the timer exceeds a threshold value after the spraying of cooling water (S34), the cooling water spray step is switched from the branch path 52*a* to the branch path 52*b*, and the evaporation step is started at the branch path 52*a*.

More specifically, the switching valve 54*a* is closed, and the switching valve 54*b* is opened. In addition, the cooling water sprayer 58*a* is stopped, and the cooling fan 60*a* and the cooling water sprayer 58*b* are operated (S36). At the heat exchanger pipe group 56*a*, ambient air is blown over the surfaces of the one or plurality of heat exchanger pipes with the cooling fan 60*a* (evaporation step). Consequently, cooling water attached to the surfaces of the one or plurality of heat exchanger pipes constituting the heat exchanger pipe group 56*a* evaporates and absorbs latent heat of vaporization from the working medium w flowing through the one or plurality of heat exchanger pipes, thereby making it possible to increase the cooling effect for cooling the working medium w.

When the elapsed time on the tinier exceeds a threshold value after the evaporation step has been started at the branch path 52*a* (S38), the cooling water spray step at the branch path 52*b* is stopped and switched to the evaporation step. In addition, the branch path 52*a* is switched to the cooling water spray step. More specifically, the cooling fan 60*a* and the cooling water sprayer 58*b* are stopped. In addition, the switching valve 54*a* is opened, and the switching valve 54*b* is closed, thereby introducing the working medium w into the branch path 52*a*. At the same time, the cooling water sprayer 58*a* and the cooling fan 60*b* are operated (S40). Next, the process returns to S34 to repeat S34 and the following steps. The control device 62 controls the start and stop and cooling water spray quantity of the cooling water sprayers 58*a* and 58*b* and the start and stop and air volume of the cooling fans 60*a* and 60*b* on the basis of the detected values of the temperature sensor 38 and/or the flow sensor 40 to control the degree of liquefaction of the working medium to a target value or within a target range, in the same way as in the first embodiment. For example, when the working medium temperature detected with the temperature sensor 38 is below a threshold value, the control device 62 judges that the working medium w has been all liquefied and cooled more than necessary, and when the flow rate of the working medium w detected with the flow sensor 40 exceeds a threshold value, the control device 62 judges that the proportion of vapor to liquid is high, and that the cooling of the working medium w is insufficient. Accordingly, the control device 62 controls the start and stop and cooling water spray quantity of the cooling water sprayers 58*a* and 58*b* and the start and stop and air volume of the cooling fans 60*a* and 60*b*, in the same way as in the first embodiment.

According to this embodiment, the working medium w is cooled by utilizing the latent heat of vaporization of cooling water, and it is therefore possible to markedly reduce the amount of cooling water used and the power required for transferring cooling water, in the same way as the first embodiment. In addition, the cooling water spray step and the evaporation step are alternately performed at the branch paths 52*a* and 52*b* of two systems, thereby enabling sufficient time to be taken for the evaporation step. Accordingly, the cooling effect for cooling the working medium w can be increased.

It should be noted that, in this embodiment, the branch paths 52*a* and 52*b* of two systems are provided, and the timer setting of elapsed time is the same for both the cooling water spray step and the evaporation step. In this regard, if branch paths of three or more systems are provided, the elapsed time of the cooling water spray step and that of the evaporation step can be made different from each other for each branch path while allowing the operation of the binary electric power generating apparatus 10B to be continued with a heat exchanger pipe group provided in any of the branch paths. With this structure, an optimum elapsed time can be set for each step. Accordingly, the cooling effect for cooling the working medium w can be further increased. In this case, the elapsed time of the cooling water spray step and the elapsed time of the evaporation step at each branch path are measured by using respective timers.

Further, the present invention can use low-boiling point working mediums other than organic working mediums, for example, aqua ammonia, pentane, etc.

It is possible according to the present invention to realize a power generating apparatus capable of markedly reducing the amount of cooling water used and the power cost required to transfer cooling water and capable of forming a Rankine cycle exhibiting excellent thermal efficiency.

In the power generating apparatus according to one embodiment of the present invention, the condensing mechanism comprises at least one heat exchanger pipe through which a working medium flows, a cooling water sprayer configured to spray cooling water over one or a plurality of heat exchanger pipes of the at least one heat exchanger pipe, and a cooling fan configured to blow ambient air over the one or a plurality of heat exchanger pipes to evaporate cooling water attached to the surface of the one or a plurality of heat exchanger pipes. With this structure, cooling water is sprayed over the surface of the heat exchanger pipe with the cooling water sprayer, and thereafter, ambient air is blown over the heat exchanger pipe having the cooling water attached thereto with the cooling fan. Consequently, when the cooling water attached to the surface of the one or a plurality of heat exchanger pipes evaporates, the cooling water absorbs a large amount of latent heat of vaporization from the working medium flowing through the one or a plurality of heat exchanger pipes. Accordingly, it is possible to increase the cooling effect for cooling the working medium. Thus, the power generating apparatus performs not only sensible heat exchange between the working medium and cooling water but also latent heat exchange. Therefore, the power generating apparatus does not require a large amount of cooling water and dispenses with the pumping power and piping installation otherwise required to transfer a large amount of cooling water.

The power generating apparatus according to one embodiment of the present invention further includes a liquefaction degree detecting device provided in the working medium flow path at the outlet side of the condensing mechanism to detect the degree of liquefaction of the working medium, and a control device supplied with a detected value from the liquefaction degree detecting device to control the respective operations of the cooling water sprayer and the cooling fan on the basis of the detected value to control the degree of liquefaction of the working medium to a target value or within a target range. With this structure, the degree of liquefaction of the working medium at the outlet of the condensing mechanism can be controlled to a target value or within a target range, and it is therefore possible to form stably a Rankine cycle exhibiting excellent thermal efficiency.

It should be noted that driven machines to which the present invention is applicable include electric power generators; however, the present invention is also applicable to driven machines other than electric power generators. For example, driving three (torque) generated by the expander can be used as auxiliary power of a driving device, e.g. a motor, as it is.

As one embodiment of the present invention, the condensing mechanism may further have a temperature sensor configured to detect the ambient temperature of the at least one heat exchanger pipe. The at least one heat exchanger pipe may have a plurality of heat exchanger pipes provided in series to the working medium flow path. One of the plurality of heat exchanger pipes may be provided with the cooling water sprayer and the cooling fan. Another of the plurality of heat exchanger pipes may be provided with a second cooling fan configured to blow ambient air thereover. In this case, the control device has the function of controlling the operation of the second cooling fan according to a detected value of the temperature sensor.

Providing the second cooling fan makes it possible to increase the cooling effect for cooling the working medium in the heat exchanger pipes of the condensing mechanism, and controlling the operation of the second cooling fan through the control device makes it possible to accurately control the degree of liquefaction of the working medium at the outlet of the condensing mechanism.

As another embodiment of the present invention, the condensing mechanism may have a plurality of heat exchanger pipes provided in parallel to the working medium flows path. The heat exchanger pipes are each provided with a cooling water sprayer and a cooling fan. The condensing mechanism is further provided with a switching device configured to selectively switch the inflow of the working medium to the plurality of heat exchanger pipes (i.e. selectively switch the inflow of the working medium to the plurality among the heat exchanger pipes). The switching device is controlled by the control device to alternately perform, at each of the plurality of heat exchanger pipes, a cooling water spray step of allowing the working medium to flow into the heat exchanger pipe and of spraying cooling water over the heat exchanger pipe with the cooling water sprayer, and an evaporation step of blowing ambient air over the heat exchanger pipe sprayed with the cooling water.

Thus, the cooling water spray step and the evaporation step are alternately performed at each heat exchanger pipe, thereby making it possible to folly utilize the working medium cooling effect by the latent heat of vaporization at each heat exchanger pipe. Accordingly, the cooling effect for cooling the working medium can be increased.

The arrangement may be as follows. The power generating apparatus further includes one or a plurality of timers for measuring the elapsed time of each of the cooling water spray step and the evaporation step, and the control device controls the switching device on the basis of the time measured with the one or a plurality of timers. With this structure, the time of each of the cooling water spray step and the evaporation step can be controlled accurately.

As one embodiment of the liquefaction degree detecting device, a temperature sensor configured to detect the temperature of the working medium may be provided at the outlet of the condensing mechanism. The degree of liquefaction (gas-liquid two-phase mixing ratio) of the working medium can be obtained by comparing the detected value of the temperature sensor with the known saturation temperature of the working medium at the pressure in the condenser.

As another embodiment of the liquefaction degree detecting device, a flow sensor configured to detect the flow rate of the working medium may be provided at the outlet of the condensing mechanism. The gas-liquid mixing ratio of the working medium can be obtained by detecting the flow rate of the working medium and comparing the detected value with the flow rate of the working medium when the whole quantity of the working medium is liquid.

Further, the liquefaction degree detecting device may be a combination of a temperature sensor configured to detect the temperature of the working medium and a flow sensor configured detect the flow rate of the working medium. In this case, when the working medium temperature detected with the temperature sensor is below a threshold value, it is judged that the working medium has been all liquefied and cooled more than necessary, and when the flow rate of the working medium detected with the flow sensor exceeds a threshold value, it is judged that the proportion of vapor to liquid is high, and that the cooling of the working medium is insufficient. Based on these judgment results, the operations of the cooling water sprayer and the cooling fan are controlled.

A heat exchanger may be further provided in the working medium flow path, through which heat exchanger a refrigerant or brine for cooling the working medium circulates. With this structure, the working medium can be cooled even more reliably by cooling with the additional heat exchanger. In addition, because the above-described latent heat exchange is performed, the power generating apparatus does not require a large amount of cooling water and can dispense with the pumping power and piping installation otherwise required to transfer a large amount of cooling water.

The power generating apparatus may further include a heat exchanger provided in the working medium flow path, through which heat exchanger a refrigerant or brine for cooling the working medium circulates. Through the additional heat exchanger, a refrigerant or brine is circulated, which has been cooled in a refrigerator constituting a refrigerating cycle, which is provided separately. The cooling capacity is reinforced by cooling the working medium with the refrigerant or brine sent from the refrigerator. When the cooling effect of the condensing mechanism is not sufficient, the additional heat exchanger can supplement the cooling effect.

In the above-described power generating apparatus, the driven machine may be an electric power generator.

The operating method according to one embodiment of the present invention is applicable to a power generating apparatus including a condensing mechanism having a plurality of heat exchanger pipes provided in parallel to a working medium flow path, and a cooling water sprayer and a cooling fan, which are provided tier each of the plurality of heat exchanger pipes, and further having a switching device configured to selectively switch the inflow of a working medium to the plurality of heat exchanger pipes. According to the operating method, the power generating apparatus is operated to alternately perform, at each of the plurality of heat exchanger pipes, a cooling water spray step of allowing the working medium to flow into the heat exchanger pipe and of spraying cooling water over the heat exchanger pipe with the cooling water sprayer, and an evaporation step of blowing ambient air over the heat exchanger pipe sprayed with the cooling water.

Thus, sufficient time can be taken for the evaporation step, and it is possible to fully utilize the working medium cooling effect by the latent heat of vaporization at each heat exchanger pipe. Accordingly, the cooling effect for cooling the working medium can be increased. Particularly, when the driven machine is an electric power generator, natural energy can be used effectively.

According to the above-described embodiments, the power generating apparatus performs not only sensible heat exchange between the working medium and cooling water but also latent heat exchange in the condensing step. Therefore, the power generating apparatus does not require a large amount of cooling water and dispenses with the pumping power and piping installation otherwise required to transfer a large amount of cooling water. In addition, it is possible to control the degree of liquefaction of the working medium at the outlet of the condensing mechanism, and hence possible to form an ideal Rankine cycle exhibiting excellent thermal efficiency.

Although only some exemplary embodiments of this invention have been described in detail above, those skilled in the art will readily appreciate that ninny modifications are possible in the exemplary embodiments without materially departing from the novel teaching and advantages of this invention. Accordingly, all such modifications are intended to be included within the scope of this invention.

The present application claims priority to Japanese Patent Application No. 2013-026853 filed on Feb. 14, 2013. The entire disclosure of Japanese Patent Application No. 2013-026853 filed on Feb. 14, 2013, including specification, claims, drawings and summary, is incorporated herein by reference in its entirety.

The entire disclosure of Japanese Patent Laid-Open Publication No. 2011-214430 (Document 1), including specification, claims, drawings and summary, is incorporated herein by reference in its entirety.

What is claimed is:

1. A power generating apparatus comprising:

an evaporator configured to evaporate a working medium with a heating medium supplied from an outside of a working medium flow path;

an expander to which a driven machine is connected and which is configured to convert expansion force of the evaporated working medium into rotational force to drive the driven machine;

a condensing mechanism configured to condense the working medium discharged from the expander with a cooling medium supplied from the outside of the working medium flow path, the condensing mechanism having:

at least one heat exchanger pipe through which the working medium flows, the at least one heat exchanger pipe including a first exchanger pipe and a second exchanger pipe serially connected with the first exchanger pipe in the working medium flow path, a first cooling water sprayer configured to spray cooling water as the cooling medium over the first exchanger pipe, a first cooling fan configured to blow ambient air over the first exchanger pipe to evaporate cooling water attached to a surface of the first exchanger pipe, and a second cooling fan configured to blow ambient air over the second exchanger pipe;

a circulating pump configured to pressurize and supply the condensed working medium to the evaporator;

a working medium temperature sensor provided in the working medium flow path at an outlet side of the condensing mechanism and configured to detect a temperature of the working medium;

a flow sensor provided in the working medium flow path at an outlet side of the condensing mechanism and configured to detect a flow rate of the working medium; and a control device configured to control a degree of liquefaction of the working medium through the condensing mechanism to a target value or within a target range, the control device configured to be supplied with detected values from the working medium temperature sensor and the flow sensor, the control device configured to compare the working medium temperature detected by the working medium temperature sensor with a first threshold value, and stop an operation of the second cooling fan when the working medium temperature detected by the working medium temperature sensor is below the first threshold value, and configured to compare the flow rate detected by the flow sensor with a second threshold value, and start an operation of the second cooling fan when the flow rate detected by the flow sensor exceeds the second threshold value.

2. The power generating apparatus of claim 1, wherein the condensing mechanism further includes an ambient temperature sensor detecting an ambient temperature of the at least one heat exchanger pipe;

wherein the control device is configured to control an operation of the second cooling fan according to a detected value of the ambient temperature sensor.

3. The power generating apparatus of claim 1, further comprising:

a heat exchanger provided in the working medium flow path, through which a refrigerant or brine for cooling the working medium circulates.

4. The power generating apparatus of claim 1, wherein the driven machine is an electric power generator.

5. A power generating apparatus comprising:

an evaporator configured to evaporate a working medium with a heating medium supplied from an outside of a working medium flow path;

an expander to which a driven machine is connected and which is configured to convert expansion force of the evaporated working medium into rotational force to drive the driven machine;

a condensing mechanism configured to condense the working medium discharged from the expander with a cooling medium supplied from the outside of the working medium flow path, the condensing mechanism having:

at least one heat exchanger pipe through which the working medium flows, the at least one heat exchanger pipe including a first exchanger pipe and a second exchanger pipe provided in parallel to the working medium flow path, a first cooling water sprayer provided for the first exchanger pipe and configured to spray cooling water as the cooling medium over the first exchanger pipe, a first cooling fan provided for the first exchanger pipe and configured to blow ambient air over the first exchanger pipe to evaporate cooling water attached to a surface of the first exchanger pipe, a second cooling water sprayer provided for the second exchanger pipe and configured to spray cooling water as the cooling medium over the second exchanger pipe, and a second cooling fan provided for the second exchanger pipe and configured to blow ambient air over the second exchanger pipe to evaporate cooling water attached to a surface of the second exchanger pipe;

a circulating pump configured to pressurize and supply the condensed working medium to the evaporator;

a switching device configured to selectively switch inflow of the working medium to the first and second exchanger pipes;

a working medium temperature sensor provided in the working medium flow path at an outlet side of the condensing mechanism and configured to detect a temperature of the working medium;

a flow sensor provided in the working medium flow path at an outlet side of the condensing mechanism and configured to detect a flow rate of the working medium; and a control device configured to control a degree of liquefaction of the working medium through the condensing mechanism to a target value or within a target range, wherein the control device controls the switching device to alternately perform, at each of the first and second exchanger pipes:

a cooling water spray step of allowing the working medium to flow into the first or second exchanger pipes and of spraying cooling water over the first or second exchanger pipes, into which the working medium flows, with the first or second cooling water sprayer, and an evaporation step of blowing ambient air over the first or second exchanger pipes sprayed with the cooling water by the first or second cooling fan, wherein the control device is configured to be supplied with detected values from the working medium temperature sensor and the flow sensor, and the control device is configured to control a delivery flow rate of the circulating pump, the start and stop and cooling water spray quantity of the first and second cooling water sprayer, the start and stop and air volume of the first and second cooling fan, based on the working medium temperature detected by the working medium temperature sensor and the flow rate of the working medium detected by the flow sensor.

6. The power generating apparatus of claim 5, further comprising:

one or a plurality of timers configured to measure an elapsed time of each of the cooling water spray step and the evaporation step;

wherein the control device controls the switching device based on a time measured with the one or plurality of timers.

7. A method of operating a power generating apparatus, the power generating apparatus including:

an evaporator configured to evaporate a working medium with a heating medium supplied from an outside of a working medium flow path;

an expander to which a driven machine is connected and which is configured to convert expansion force of the evaporated working medium into rotational force to drive the driven machine;

a condensing mechanism configured to condense the working medium discharged from the expander with a cooling medium supplied from the outside of the working medium flow path; and a circulating pump configured to pressurize and supply the condensed working medium to the evaporator;

a working medium temperature sensor provided in the working medium flow path at an outlet side of the condensing mechanism and configured to detect a temperature of the working medium;

a flow sensor provided in the working medium flow path at an outlet side of the condensing mechanism and configured to detect a flow rate of the working medium; and a control device configured to control a degree of liquefaction of the working medium through the condensing mechanism to a target value or within a target range, the control device being configured to be supplied with detected values from the working medium temperature sensor and the flow sensor;

the condensing mechanism having a plurality of heat exchanger pipes provided in parallel to the working medium flow path, a cooling water sprayer and a cooling fan, which are provided for each of the plurality of heat exchanger pipes, and a switching device configured to selectively switch inflow of the working medium to the plurality of heat exchanger pipes; the method comprising:

alternately performing at each of the plurality of heat exchanger pipes, a cooling water spray step of allowing the working medium to flow into the heat exchanger pipe and of spraying cooling water over the heat exchanger pipe with the cooling water sprayer, and an evaporation step of blowing ambient air with the cooling fan over the heat exchanger pipe sprayed with the cooling water; and wherein delivery flow rate of the circulating pump, the start and stop and cooling water spray quantity of the cooling water sprayer for each of the plurality of heat exchanger pipes, the start and stop and air volume of the cooling fan for each of the plurality of heat exchanger pipes are controlled based on the working medium temperature detected by the working medium temperature sensor and the flow rate of the working medium detected by the flow sensor, whereby a degree of liquefaction of the working medium through the condensing mechanism to a target value or within a target range is controlled.

8. The method of claim 7, wherein an elapsed time of each of the cooling water spray step and the evaporation step is measured with one or a plurality of timers, and switching by the switching device is controlled on a basis of the time measured with the one or plurality of timers.

9. The method of claim 7, wherein a temperature sensor configured to detect a temperature of the working medium and a flow sensor configured to detect a flow rate of the working medium are provided in the working medium flow path, and when the temperature of the working medium detected with the temperature sensor is below a first threshold value, it is judged that the working medium has been all liquefied and cooled more than necessary, and when the flow rate of the working medium detected with the flow sensor exceeds a second threshold value, it is judged that a proportion of vapor to liquid is high, and that cooling of the working medium is insufficient, and wherein, based on these judgment results, respective operations of the cooling water sprayer and the cooling fan are controlled.

10. The method of claim 7, wherein the working medium is further cooled by an additional heat exchanger provided in the working medium flow path, through which heat exchanger a refrigerant or brine circulates, the additional heat exchanger being separate from the plurality of heat exchangers pipes provided in parallel.

11. The method of claim 7, wherein the driven machine is an electric power generator.

* * * * *